US005754491A

United States Patent [19]

Cushman

[11] Patent Number: 5,754,491

[45] Date of Patent: May 19, 1998

[54] MULTI-TECHNOLOGY ACOUSTIC ENERGY BARRIER AND ABSORBER

[75] Inventor: William B. Cushman, Pensacola, Fla.

[73] Assignee: Poiesis Research, Inc., Pensacola, Fla.

[21] Appl. No.: 804,930

[22] Filed: Feb. 24, 1997

[51] Int. Cl.[6] ..... G10K 11/16

[52] U.S. Cl. ..... 367/1; 181/284

[58] Field of Search ..... 367/1; 181/284, 181/294

[56] References Cited

U.S. PATENT DOCUMENTS

| | | | |
|---|---|---|---|
| 5,272,284 | 12/1993 | Schmanski | 181/284 |
| 5,400,296 | 3/1995 | Cushman et al. | 367/1 |
| 5,526,324 | 6/1996 | Cushman | 367/1 |
| 5,536,910 | 7/1996 | Harrold et al. | 181/290 |
| 5,706,249 | 1/1998 | Cushman | 367/1 |

OTHER PUBLICATIONS

Hartmann & Jarzyuski "Ultrasonic Hysteresis Absorption in Polymers" *J. Appl. Phys.* vol. 43, No. 11, Nov. 72.

U.S. application No. 08/780271, Cushman, filed Jan. 9, 1997.

*Primary Examiner*—Daniel T. Pihulic

[57] ABSTRACT

A multi-technology acoustic energy barrier and absorber is disclosed that employs the teaching of U.S. Pat. No. 5,400,296 for a matrix material with at least two species of particles with differing characteristic acoustic impedances, in combination with the teaching of U.S. patent Pending Ser. No., 08/780,271, for an "Acoustic Absorption or Damping Material with Integral Viscous Damping," and with the principles underlying constrained-layer dampers.

18 Claims, 3 Drawing Sheets

MULTI-TECHNOLOGY ACOUSTIC ENERGY BARRIER AND ABSORBER

BACKGROUND OF THE INVENTION

1. Field of the Invention

This invention relates to acoustic absorption and barrier structures. Specifically, the instant invention relates to acoustic absorption and barrier structures that may combine viscous damping and phase shifting at the second acoustic medium interface with acoustic dispersion and phase cancellations within the structural matrix and with the principles underlying constrained-layer damping structures.

2. Description of Related Art

In a closed system, absorbing or damping unwanted acoustic or vibrational energy involves converting acoustic energy into another form, usually heat. Heat and acoustic or vibrational energy are closely related. At the molecular level the primary distinction between heat energy and acoustic or vibrational energy lies in the vector direction of molecular displacements. Acoustic and vibrational energy is characterized by molecular displacements with vector directions that are highly correlated, with large numbers of molecules displacing at the same time and in the same direction. Heat in a medium may well have the same or more energy than propagating acoustic or vibrational energy, but the motion of the molecules is in random directions with the mean molecular displacement at any given location being near zero. To dissipate acoustic or vibrational energy as heat thus involves mechanisms that de-correlate molecular movements into random directions.

Several techniques are available for de-correlating molecular movements into random directions. For example, Cushman, et al. (U.S. Pat. No. 5,400,296) teach the use of two or more species of particles with differing characteristic acoustic impedances embedded in a matrix material. Within the matrix material reflections at boundaries with higher impedance particles are in phase, and reflections at boundaries with lower impedance particles are out of phase. Reflections with different phase relationships at or near the same locale increase the probability of phase cancellations. Phase cancellations de-correlate molecular movements into random directions.

A second approach to de-correlating molecular movements involves the careful choice of matrix materials that exhibit a high degree of internal hysteresis. Internal hysteresis within the material is thought to be caused by metastable molecular energy levels. Propagating acoustic or vibrational energy may boost a particular molecule into a higher energy level, thus subtracting that energy from propagating energy, where the molecule remains for some time before randomly returning to its original energy level. For a discussion of this effect see Hartmann and Jarzynski, "*Ultrasonic hysteresis absorption in polymers,*" *J. Appl. Phys.*, Vol. 43, No. 11, November 1972, 4304–4312.

A third method for redirecting the molecular movements of acoustic or vibrational energy is to convert this energy into electricity using the piezoelectric effect, and to dissipate it as heat through resistive heating. Cushman, (U.S. Pat. No. 5,526,324) has made piezoelectrically active acoustic damping materials by embedding graphite within polyvinylidene fluoride (PVDF) and PVDF co-polymers. The β crystalline phase of PVDF is piezoactive. Graphite particles embedded in β crystalline PVDF or co-polymers thereof provide a path for local currents to flow and produce heat resistively.

In addition to the various techniques for increasing acoustic absorption or vibration damping within a material, the shape of a material conducting acoustic or vibratory energy can be made to redirect acoustic energy in harmless directions or to promote viscous damping at an interface. For example, Cushman's U.S. Pat. No. 5,706,249 "Panel spacer with acoustic and vibration damping" teaches the technique of focusing acoustic energy between panels into a small area and re-directing it laterally. Cushman's Pending U.S. patent Ser. No. 08/780,271 teaches the use of viscous damping with tortuous pores within an absorptive material. Porous outer layers can be very advantageous. They may promote viscous damping within the interfacing medium, provide a larger surface area with the interfacing medium, and may act as phase shifters by exploiting the fact that the speed of sound in solid materials is much higher than in a gas.

Another technique based upon the shape of a barrier material is to form a constrained-layer damper. Constrained-layer dampers exploit the fact that the lateral tensile stiffness of the outer layers is greater than a "constrained layer." When the entire structure is deformed the layer away from the deformation will resist assuming a longer arc than the inner layer and force a shear deformation upon the constrained layer, thus causing localized amplification of movement in the lateral direction and energy redirection laterally.

It can be shown experimentally that thin panel sections with very good barrier capability are possible using the Cushman, et al (U.S. Pat. No. 5,400,296) techniques described above. However, these panels are not immune to the laws of mechanics and when thin panel sections are attempted, the entire panel will simply follow Newton's well known relationship, F=ma. That is, the entire panel will move over in response to a pressure wave and act as a diaphragm on the opposite surface, thus re-creating the original pressure wave. Very little energy will enter the material where it may be dissipated. The only effective ways to prevent movement of thin sections in response to acoustic pressure are to a), increase the mass of the panel, b), to design the structure to optimize the stiffness of the panel against its support, and c), to reduce the resistance of the panel to incoming pressure waves by making it porous. In many applications increasing the mass of a barrier structure is not desirable, but increasing the stiffness is acceptable as is decreasing the resistance of the panel by making it porous. A porous panel is a good absorber but is not a good barrier. It may, however, be attached to a barrier panel and the combination provide benefits that neither can provide alone.

SUMMARY OF THE INVENTION

Accordingly, an object of the instant invention is to provide an improved acoustic absorption or vibration damping material structure that uses the Cushman, et al. principle of multiple species particles within a matrix material, described in U.S. Pat. No. 5,400,296, in conjunction with a structural design that promotes stiffness in large panels, reduces weight, reduces the resistance of the panel to incoming pressure waves, substantially increases the surface area of the interface between media, induces local phase shifting due to the structural shape, and promotes viscous damping internally and at the interface with the interfacing medium. These and additional objects of the invention may be accomplished by mixing blowing and nucleating agents into a material according to the teaching of U.S. Pat. No. 5,400,296, at a sufficient concentration such that processing conditions yield a plurality of tortuous passageways within the material. That is, the material becomes an open-celled foam. An open celled foam structure made according to the teaching of the instant invention is an excellent acoustic absorber and reflects much less energy than a comparable barrier structure without internal tortuous passageways. An open celled foam structure increases the surface area at the interface between media; aids in promoting energy transfer from one medium to the other thus improving the ability of the structure to act as an acoustic absorber rather than as a reflector; is stiffer per unit of weight or lighter per unit of stiffness; induces internal phase shifting due to the fact that the speed of sound within the foam structure is higher than within the interfacing medium if that interfacing medium is air; presents a lower resistance to incoming pressure waves; and, induces viscous damping within the tortuous passageways of the structure. A further object of the instant invention is to combine the teaching of the instant invention for making acoustic absorbers with various combinations of barrier configurations, absorber configurations and, constrained-layer configurations that are effective in various situations.

In one embodiment of the instant invention at least one side of a structure made according to the teaching of the instant invention contains no through passageways, either because a second barrier layer has been attached or because processing conditions have been adjusted to achieve this end. For example, an extruded melt containing a blowing agent can be extruded onto a chilled surface that prevents blowing on one side of the melt to achieve the end of a closed barrier on one side of an open-celled foam structure. In a second embodiment of the instant invention both sides of an open-celled foam structure are processed to form closed barriers. The barrier portions of the structure have greater lateral tensile strength than the open-celled portion and thus form a constrained-layer damping structure. In a third embodiment of the instant invention a barrier layer is placed between two absorption layers made according to the teaching of the instant invention to provide excellent absorption from either direction while also providing a good acoustic barrier. In a fourth embodiment of the instant invention two absorption layers made according to the teaching of the instant invention are interleaved with two barrier layers to provide a structure with good absorption from one side in combination with a constrained-layer type of barrier. In a fifth embodiment of the instant invention two barrier layers form a constrained-layer damping structure with an absorption layer, and are faced with second and third absorption layers on either side to provide a good bi-directional absorption structure with an integral constrained-layer damper type barrier.

BRIEF DESCRIPTION OF THE DRAWINGS

In the following Description of the Preferred Embodiments and the accompanying drawings, like numerals in different figures represent the same structures or elements. The representation in each of the figures is diagrammatic and no attempt is made to indicate actual scales or precise ratios. Proportional relationships are shown as approximations in some cases and exaggerated in others for clarity.

DESCRIPTION OF THE PREFERRED EMBODIMENTS

The parts indicated on the drawings by numerals are identified below to aid in the reader's understanding of the present invention.

10. Absorption layer.
20. Tortuous passageways.
30. Absorption layer matrix material.
40. High impedance particles.
50. Low impedance particles
60. Barrier layer matrix material.
70. Barrier layer.
80. Second barrier layer.
90. Second absorption layer.
100. Third absorption layer.

Figure 1:
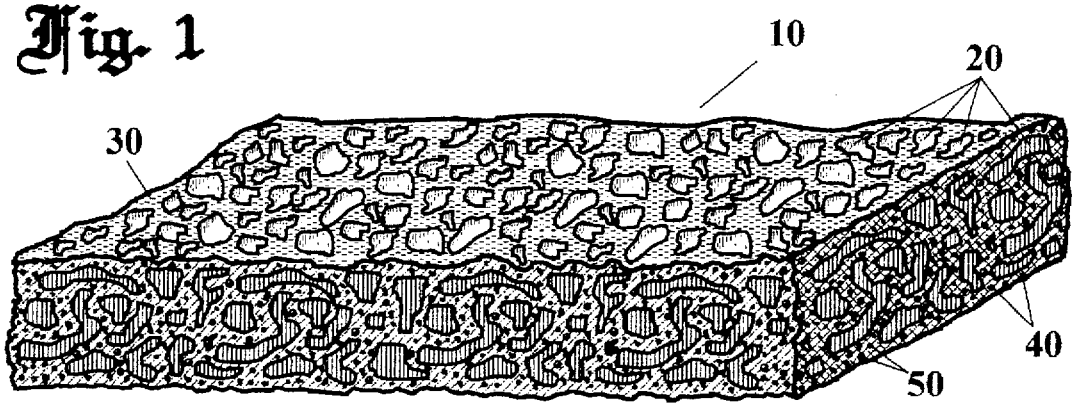
FIG. 1 shows a section of a partial embodiment of the instant invention as an absorption layer with high and low impedance particles in a matrix material with tortuous passageways therein.
Figure 2:
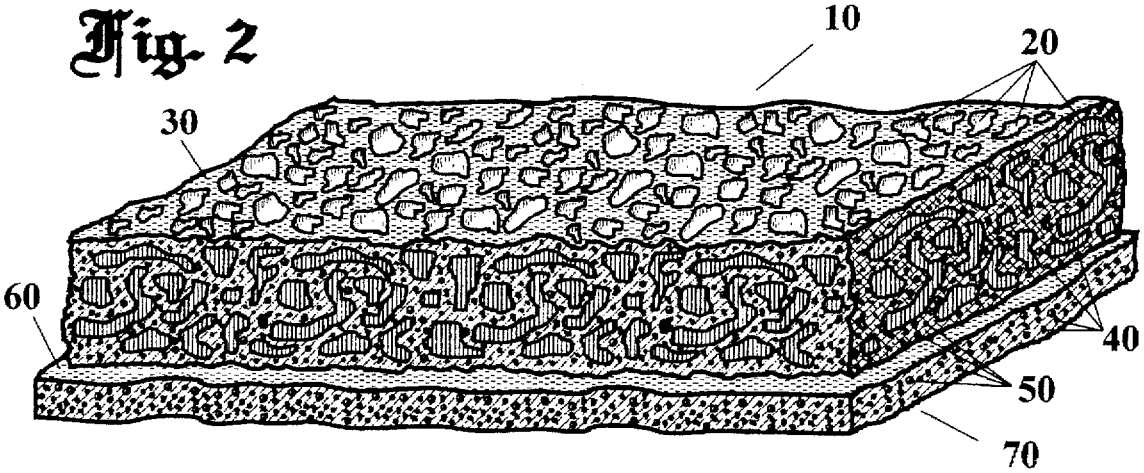
FIG. 2 shows a section of a partial embodiment of the instant invention as an absorption layer with high and low impedance particles in a matrix material with tortuous passageways therein and an attached barrier layer with high and low impedance particles.

A section of a partial embodiment of the instant invention is shown in FIG. 1 with high impedance particles 40 and low impedance particles 50 in a matrix material 30 with tortuous passageways 20 therein. The use of high and low characteristic impedance particles within a matrix material for acoustic purposes is taught in U.S. Pat. No. 5,400,296 issued to Cushman, et al. and will not be elaborated here. Tortuous passageways, 20, within the matrix material of the section of an embodiment of the instant invention shown in FIG. 1 are generally contiguous with each other and with the upper and the lower surfaces of a panel made from the acoustic or damping material of the instant invention. Tortuous passageways may be formed by following the usual well known practices for creating open-celled foams. That is, by the addition of blowing and nucleating agents to the matrix material during processing, followed by allowing the material to expand at an appropriate temperature. The high and low impedance particles of the instant invention may serve as nucleating agents. The high impedance particles may also serve as thermal retention points during expansion of the melt, thus providing local areas of low viscosity to promote formation of tortuous passageways. The tortuous passageways of the section of an embodiment of the instant invention of FIG. 1 serve to: a) reduce acoustic reflectivity at the surface by reducing the resistance of the panel to incoming pressure waves; b) provide channels within which the interfacing medium such as air can interact viscously; c) increase the surface area between interfacing media to promote energy transfer from one medium to the other; d) improve structural stiffness by adding thickness without adding weight and; e) induce local phase shifting due to the difference in transit times for acoustic energy in solid materials and gasses. A preferred high impedance particle species is iron and a preferred low impedance particle species is ceramic microspheres. The section of an embodiment of the instant invention shown in FIG. 1 may be manufactured by mixing the particle species (preferably iron and ceramic microspheres) and a blowing agent into a suitable matrix material and extruding the resulting mixture following standard procedures for sheeting and forming open-celled foams. The structure shown in FIG. 1 is an absorption layer, 10, of the instant invention. A section of a partial embodiment of the instant invention is shown in FIG. 2 with high impedance particles 40 and low impedance particles 50 in a matrix material 30 with tortuous passageways 20 therein. The upper part of the structure shown in FIG. 2 is an absorption layer, 10, of the instant invention. Firmly attached to the absorption layer, 10, of FIG. 2 is a barrier layer, 70, comprised of a matrix material, 60, with embedded high impedance particles, 40, and low impedance particles, 50. Barrier layer, 70, is made according to the teaching of U.S. Pat. No. 5,400,296 issued to Cushman, et al. The combination of absorption layer, 10, with barrier layer, 70, forms an acoustic structure with all the barrier qualities inherent to barrier layer, 70, enhanced by the added structural support and mass provided by absorption layer, 10, plus all of the absorptive qualities of absorption layer 10. The section of an embodiment of the instant invention shown in FIG. 2 may be manufactured by mixing the particle species (preferably iron and ceramic microspheres) and a blowing agent into a suitable matrix material and extruding the resulting mixture following standard procedures for sheeting and forming open-celled foams while simultaneously co-extruding the barrier layer under the absorption layer. Or, the mix of matrix material, particles and blowing agent may be extruded onto a chilled surface that prevents the blowing agent from activating near the chilled surface to provide a barrier layer as part of an absorption layer.

Figure 3:
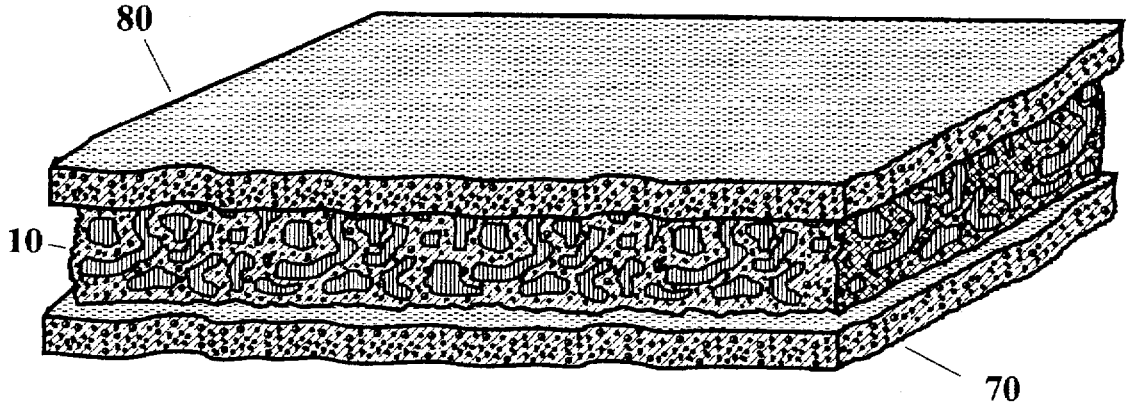
FIG. 3 shows a section of an embodiment of the instant invention with an absorption layer of the instant invention faced on both sides with barrier layers of the instant invention.
Figure 4:
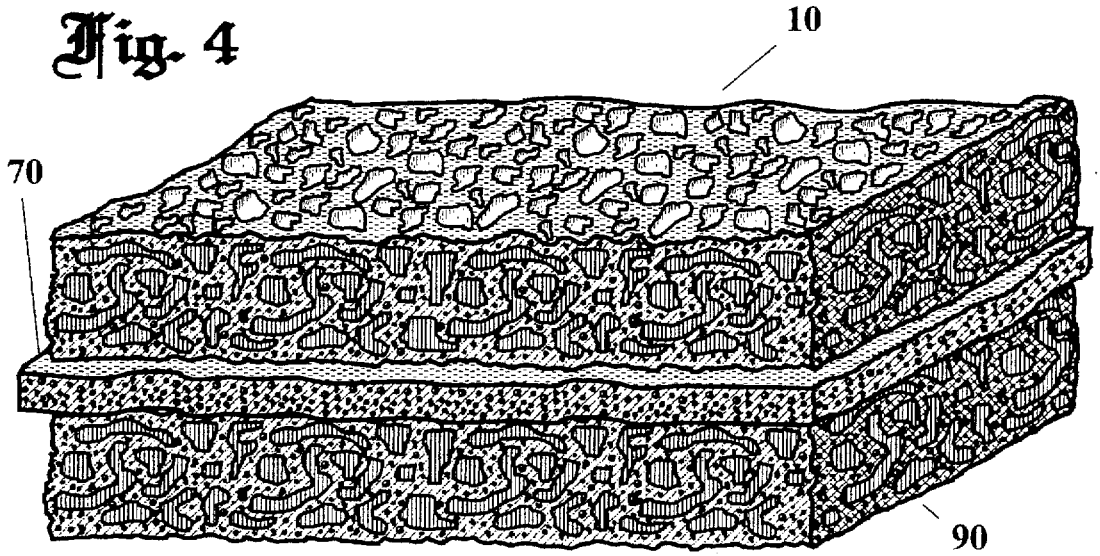
FIG. 4 shows a section of an embodiment of the instant invention with a barrier layer of the instant invention faced on both sides with absorption layers of the instant invention.

A section of a preferred embodiment of the instant invention is shown in FIG. 3 with an absorption layer, 10, of the instant invention flanked on one side by barrier layer 70 and the other side by second barrier layer 80. Barrier layers 70 and 80 in FIG. 3 are firmly attached to absorption layer, 10, of FIG. 3. Barrier layers 70 and 80 are made according to the teaching of U.S. Pat. No. 5,400,296 issued to Cushman, et al. The combination of absorption layer, 10, with barrier layers, 70 and 80, forms an acoustic structure with all the barrier qualities inherent to barrier layers, 70 and 80, enhanced by the added structural support and mass provided by absorption layer, 10, all of the absorptive qualities of absorption layer 10, and the advantages of a constrained-layer damper type of barrier. The preferred embodiment of the instant invention shown in FIG. 3 is a constrained-layer damper because barrier layers, 70 and 80, are stronger in tensile strength than absorption layer 10 due to the presence of tortuous passageways in absorption layer 10. Deformation of one of the barrier layers will cause absorption layer 10 to compress and deform laterally rather than transmit the deformation directly through the structure. Lateral deformation of absorption layer 10 redirects the energy of deformation and dissipates it. The relative structural weakness of absorption layer 10 also serves to de-couple energy directed through the embodiment of the instant invention shown in FIG. 3. A section of a preferred embodiment of the instant invention is shown in FIG. 4 with a barrier layer, 70, of the instant invention flanked on one side by absorption layer 10 and the other side by second absorption layer 90. Absorption layers 10 and 90 in FIG. 4 are firmly attached to barrier layer 70 of FIG. 4. Barrier layer 70 is made according to the teaching of U.S. Pat. No. 5,400,296 issued to Cushman, et al. The combination of barrier layer 70 with absorption layers 10 and 90 forms an acoustic structure with all the barrier qualities inherent to barrier layer 70 enhanced by the added structural support and mass provided by absorption layers 10 and 90, and all of the absorptive qualities of absorption layers 10 and 90, thus providing bi-directional absorption with low reflection and simultaneous barrier qualities.

Figure 5:
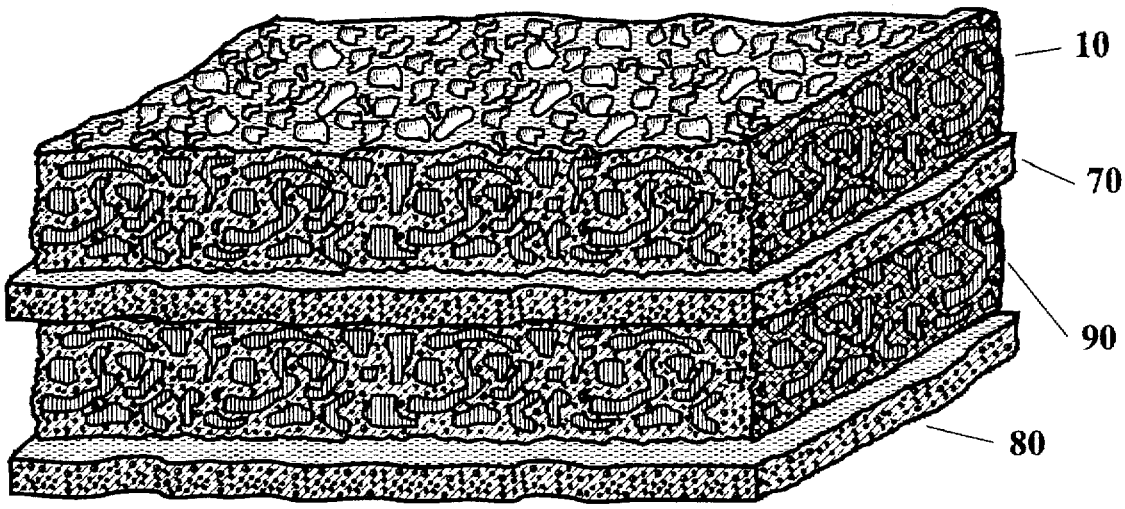
FIG. 5 shows a section of an embodiment of the instant invention with alternating barrier layers of the instant invention and absorption layers of the instant invention.

A section of a preferred embodiment of the instant invention is shown in FIG. 5 with a barrier layer, 70, of the instant invention flanked on one side by absorption layer 10 and the other side by second absorption layer 90. A second barrier layer, 80, is attached to absorption layer 90. Absorption layers 10 and 90 in FIG. 5 are firmly attached to barrier layers 70 and 80 of FIG. 5. Barrier layers 70 and 80 are made according to the teaching of U.S. Pat. No. 5,400,296 issued to Cushman, et al. The combination of absorption layers 10 and 90 with barrier layers 70 and 80 forms an acoustic structure with all the barrier qualities inherent to barrier layers 70 and 80, enhanced by the added structural support and mass provided by absorption layers 10 and 90, all of the absorptive qualities of absorption layers 10 and 90, and the advantages of a constrained-layer damper type of barrier. In addition, absorption layer 10 further enhances the qualities of the embodiment of the instant invention shown in FIG. 5 by providing all of the advantages of an absorption layer facing an acoustic source. That is, the tortuous passageways of absorption layer 10 serve to: a) reduce acoustic reflectivity at the surface by reducing the resistance of the panel to incoming pressure waves; b) provide channels within which the interfacing medium such as air can interact viscously; c) increase the surface area between interfacing media to promote energy transfer from one medium to the other; d) improve structural stiffness by adding thickness without adding weight and; e) induce local phase shifting due to the difference in transit times for acoustic energy in solid materials and gasses. The preferred embodiment of the instant invention shown in FIG. 5 is a constrained-layer damper because barrier layers 70 and 80 are stronger in tensile strength than absorption layer 90, due to the presence of tortuous passageways in absorption layer 90. Deformation of one of the barrier layers will, therefore, cause absorption layer 90 to compress and deform laterally rather than transmit the deformation directly through the structure. Lateral deformation of absorption layer 90 redirects the energy of deformation and dissipates it. The relative structural weakness of absorption layers 10 and 90 also serve to de-couple energy directed through the embodiment of the instant invention shown in FIG. 5.

Figure 6:
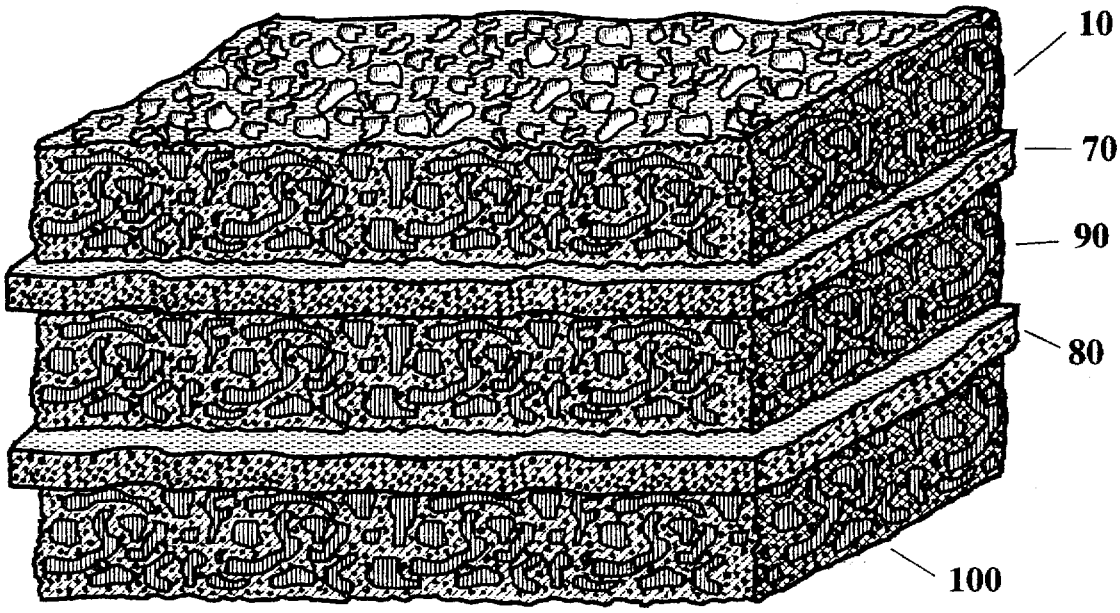
FIG. 6 shows a section of an embodiment of the instant invention with an absorption layer of the instant invention between two barrier layers of the instant invention to form a constrained-layer damper structure and with absorption layers of the instant invention attached to both outer surfaces.

A section of a preferred embodiment of the instant invention is shown in FIG. 6 with a barrier layer, 70, of the instant invention flanked on one side by absorption layer 10 and the other side by second absorption layer 90. A second barrier layer, 80, is attached to absorption layer 90 and a third absorption layer, 100, is attached to barrier layer 80. Absorption layers 10, 90 and 100 in FIG. 6 are firmly attached to barrier layers 70 and 80 of FIG. 5. Barrier layers 70 and 80 are made according to the teaching of U.S. Pat. No. 5,400,296 issued to Cushman, et al. The combination of absorption layers 10, 90 and 100, with barrier layers, 70 and 80, forms an acoustic structure with all the barrier qualities inherent to barrier layers 70 and 80 enhanced by the added structural support and mass provided by absorption layers 10, 90 and 100, all of the absorptive qualities of absorption layers 10, 90 and 100, and the advantages of a constrained-layer damper type of barrier. In addition, absorption layers 10 and 100 further enhance the barrier qualities of the embodiment of the instant invention shown in FIG. 5 by adding mass and stiffness while providing all of the advantages of absorption layers facing acoustic sources. That is, the tortuous passageways of absorption layers 10 and 100 serve to: a) reduce acoustic reflectivity at their surfaces by reducing the resistance of the panel to incoming pressure waves; b) provide channels within which the interfacing medium such as air can interact viscously; c) increase the surface area between interfacing media to promote energy transfer from one medium to the other; d) improve structural stiffness by adding thickness without adding weight and; e) induce local phase shifting due to the difference in transit times for acoustic energy in solid materials and gasses. The preferred embodiment of the instant invention shown in FIG. 6 is a constrained-layer damper because barrier layers 70 and 80 are stronger in tensile strength than absorption layer 90, due to the presence of tortuous passageways in absorption layer 90. Deformation of one of the barrier layers will cause absorption layer 90 to compress and deform laterally rather than transmit the deformation directly through the structure. Lateral deformation of absorption layer 90 redirects the energy of deformation and dissipates it. The relative structural weakness of absorption layers 10, 90 and 100 also serves to de-couple energy directed through the embodiment of the instant invention shown in FIG. 6.

Many modifications and variations of the present invention are possible in light of the above teachings. For example, a variety of matrix materials may be used, including polyester, epoxy and vinyl ester thermoset materials as well as numerous thermoplastic materials and materials known to be good acoustic absorbers, for example the DuPont company's Keldax® acoustic product. A variety of high and low impedance particle species may be used, (brass, lead, bismuth, glass microspheres, plastic microspheres). Various permutations of multiple barrier and/or absorption layers may be used. With specific applications it may be advisable to add deodorant and /or flame retardant as well. It is therefore to be understood that, within the scope of the appended claims, the instant invention may be practiced otherwise than as specifically described.

I claim:

1. An acoustic attenuation or vibration damping material comprised of at least two layers of matrix material with a plurality of tortuous passageways penetrating throughout said matrix material, and with at least two species of particles incorporated within said matrix material, said particles being species differentiated by their characteristic acoustic impedances; and with at least one barrier layer of material disposed between said acoustic attenuation or vibration damping material layers; whereby a bi-directional barrier structure is formed with at least two external absorptive layers.

2. The acoustic absorption or vibration damping material of claim 1 where said matrix material is a thermoplastic material.

3. The acoustic absorption or vibration damping material of claim 1 where said matrix material is a thermoset material.

4. The acoustic absorption or vibration damping material of claim 1 where one of said species of particles incorporated within said matrix material is iron.

5. The acoustic absorption or vibration damping material of claim 1 where one of said species of particles incorporated within said matrix material is ceramic microspheres.

6. The acoustic absorption or vibration damping material of claim 1 where said barrier layer is comprised of a matrix material with at least two species of particles incorporated therein, said particles being species differentiated by their characteristic acoustic impedances.

7. An acoustic attenuation or vibration damping material comprised of a matrix material with a plurality of tortuous passageways penetrating throughout said matrix material, and with at least two species of particles incorporated within said matrix material, said particles being species differentiated by their characteristic acoustic impedances; and with at least two constraining layers of material with a higher tensile strength than said acoustic attenuation or vibration damping material attached on either side of said acoustic attenuation or vibration damping material, whereby a constrained-layer damping barrier structure is formed.

8. The acoustic absorption or vibration damping material of claim 7 where said matrix material is a thermoplastic material.

9. The acoustic absorption or vibration damping material of claim 7 where said matrix material is a thermoset material.

10. The acoustic absorption or vibration damping material of claim 7 where one of said species of particles incorporated within said matrix material is iron.

11. The acoustic absorption or vibration damping material of claim 7 where one of said species of particles incorporated within said matrix material is ceramic microspheres.

12. The acoustic absorption or vibration damping material of claim 7 where said constraining layers are comprised of matrix material with at least two species of particles incorporated therein, said particles being species differentiated by their characteristic acoustic impedances.

13. An acoustic attenuation or vibration damping material comprised of a matrix material with a plurality of tortuous passageways penetrating throughout said matrix material, and with at least two species of particles incorporated within said matrix material, said particles being species differentiated by their characteristic acoustic impedances; and with at least two constraining layers of material with a higher tensile strength than said acoustic attenuation or vibration damping material attached on either side of said acoustic attenuation or vibration damping material; and with at least one additional outer layer comprised of an acoustic attenuation or vibration damping material comprised of a matrix material with a plurality of tortuous passageways penetrating throughout said matrix material, and with at least two species of particles incorporated within said matrix material, said particles being species differentiated by their characteristic acoustic impedances; whereby a constrained-layer damping barrier structure is formed with at least one external absorptive layer.

14. The acoustic absorption or vibration damping material of claim 13 where said matrix material is a thermoplastic material.

15. The acoustic absorption or vibration damping material of claim 13 where said matrix material is a thermoset material.

16. The acoustic absorption or vibration damping material of claim 13 where one of said species of particles incorporated within said matrix material is iron.

17. The acoustic absorption or vibration damping material of claim 13 where one of said species of particles incorporated within said matrix material is ceramic microspheres.

18. The acoustic absorption or vibration damping material of claim 13 where said constraining layers are comprised of matrix material with at least two species of particles incorporated therein, said particles being species differentiated by their characteristic acoustic impedances.

* * * * *